US005265540A

United States Patent [19]

Ducros et al.

[11] Patent Number: 5,265,540

[45] Date of Patent: Nov. 30, 1993

[54] AMMUNITION, IN PARTICULAR OF THE TELESCOPED TYPE

[75] Inventors: Pierre Ducros, Pouilly-les-Nonains; Michel J. Desevaux, Bourges, both of France; Chris G. De Veth, Saint Rémy Gust, Belgium

[73] Assignee: Giat Industries, France

[21] Appl. No.: 17,986

[22] Filed: Feb. 16, 1993

Related U.S. Application Data

[63] Continuation of Ser. No. 824,299, Jan. 23, 1992, abandoned.

[30] Foreign Application Priority Data

Jul. 31, 1991 [FR] France ..... 91 09724

[51] Int. Cl.[5] ..... F42B 5/045

[52] U.S. Cl. ..... 102/434; 102/466; 102/467; 102/469; 102/513

[58] Field of Search ..... 102/430, 433, 434, 464, 102/466, 467, 469, 470, 513

[56] References Cited

U.S. PATENT DOCUMENTS

| | | | |
|---|---|---|---|
| H61 | 5/1986 | Yuhash et al. | 102/434 |
| 3,170,401 | 2/1965 | Johnson et al. | 102/467 |
| 4,007,686 | 2/1977 | Hugonet | 102/467 |
| 4,147,107 | 3/1979 | Ringdal | 102/467 |
| 4,173,186 | 11/1979 | Dunham | 102/464 |
| 4,276,830 | 7/1981 | Pastora Alice | 102/467 |
| 4,646,644 | 3/1987 | Richmond et al. | 102/469 |
| 4,770,098 | 9/1988 | Stoner | 102/434 |
| 4,846,068 | 7/1989 | Zedrosser | 102/434 |
| 5,046,428 | 9/1991 | Jungblut et al. | 102/469 |
| 5,067,408 | 11/1991 | Martwick | 102/434 |

FOREIGN PATENT DOCUMENTS

| | | | |
|---|---|---|---|
| 401115 | 12/1990 | European Pat. Off. | 102/434 |
| 2376395 | 9/1978 | France | 102/466 |

*Primary Examiner*—Harold J. Tudor
*Attorney, Agent, or Firm*—Parkhurst, Wendel & Rossi

[57] ABSTRACT

A telescoped ammunition round including a plastic case having a cylindrical casing, a front end cap and a rear end cap, the front and rear end caps being fitted at front and rear ends of the casing. The round further includes a projectile, a propulsive charge and an ignition device disposed within the casing. Sealing means are provided to form a gas-tight seal between the front and rear end caps and the cylindrical casing to prevent escape of propellant gases generated from the propulsive charge. Importantly, axial retaining devices are included to prevent longitudinal movement of the front and rear end caps before firing, and allow movement thereof after firing, wherein the end caps are not completely separated from the casing after ignition of the propellant charge.

18 Claims, 4 Drawing Sheets

AMMUNITION, IN PARTICULAR OF THE TELESCOPED TYPE

This is a continuation of application Ser. No. 07/824,299 filed Jan. 23, 1992, now abandoned.

This invention relates to improvements made to an ammunition round, in particular a telescoped round comprising a plastic case material made up of a cylindrical casing and of two end caps inserted in opposite ends of the casing a projectile and a propulsive charge housed inside the case, and an ignition device for the propulsive charge.

Generally, in this type of ammunition, the projectile housed inside the case is not positioned when the ammunition is loaded into the chamber of the barrel of a cannon. Therefore, gas pressure resulting from the ignition of the propulsive charge displaces the projectile in order to first position it and then propel it inside the barrel of the cannon. The ammunition must therefore be perfectly sealed in order to avoid any leakage of gas, in particular at the front of the ammunition round before the projectile is positioned.

In addition to this problem of the sealing of the ammunition, there are also problems relating to the movement of the front and rear end caps from the increase inside the case of the ammunition after the propulsive charge has been ignited. Also, in order to facilitate the extraction of the case after the projectile has been fired, it is desirable for the end caps to remain connected to the casing after they have moved. Finally, another problem rests in maintaining the position of the projectile along the center line of the ammunition round during handling operations which precede firing. Various designs have been found to solve these problems for ammunition with metal cases; in this connection, it is merely necessary to refer, for example, to documents U.S. Pat. Nos. 4,691,638, 4,907,510, 4,846,069 and EP-0 328 016.

Generally, the cases for ammunition may also be made from a plastic material, as known, for example, from documents U.S. Pat. No. 4,770,098, FR-2 647 890 and FR-2 647 891. In this case, the devices found to solve the aforementioned problems must be designed in view of the special characteristics of plastic materials. In fact, the expansion coefficients of these materials are such that they cause major variations in length in the case, (approximately 1% for the entire temperature range), so it is essential to provide, in contrast to ammunition with metal cases, sufficient axial play between the case and the chamber of the barrel of the cannon. However, no ammunition as described in these latter documents, either taken separately or in combination, comprises the necessary devices for solving all of the problems mentioned above for an ammunition round having a plastic case.

The object of the invention is to design an ammunition round with a plastic case which solves the above problems such as sealing and movement of the end caps, while taking account of the effect on the plastic material of the increase of the pressure inside the case after the propulsive charge has been ignited.

Therefore, the invention proposes a telescoped ammunition round having sealing devices between the end caps and the casing, devices for axially securing the end cap before ignition of the propulsive charge, and in that the end caps are mounted so that they can move but remain joined to the casing after ignition of the propulsive charge.

According to a first embodiment of the invention, the front end cap is made up of a ring finished at one end with an annular seal with a lip, such that the body of the ring slides against the casing and the annular seal with lip is pressed against the the casing, with the rear end cap also being fitted with a seal with a lip being mounted in a similar way to that of the front end cap.

The axial securing devices for the end caps are, for example, made up of radial pins which pass through the casing and penetrate into the end cap, these pins being sheared or deformed after ignition of the propulsive charge in order to allow the end cap to move relative to the casing while remaining connected to it. Therefore, the end caps are sufficiently long to remain connected to the casing after they have moved as a result of the ignition of the propulsive charge.

According to another embodiment, devices are provided at the front and rear end caps to prevent creep in the plastic material after ignition of the propulsive charge. Finally, according to another embodiment of the invention, devices are provided which maintain the projectile in the centre line of the ammunition, for example during handling before firing of the projectile.

Thus, ammunition conforming to the invention has all of the necessary devices to solve the problems encountered before, during and after firing of the projectile. Additionally, the devices used are simple and inexpensive.

Further advantages, features and details of the invention will emerge from the description which follows of example embodiments, and from the accompanying drawings in which.

Figure 8:
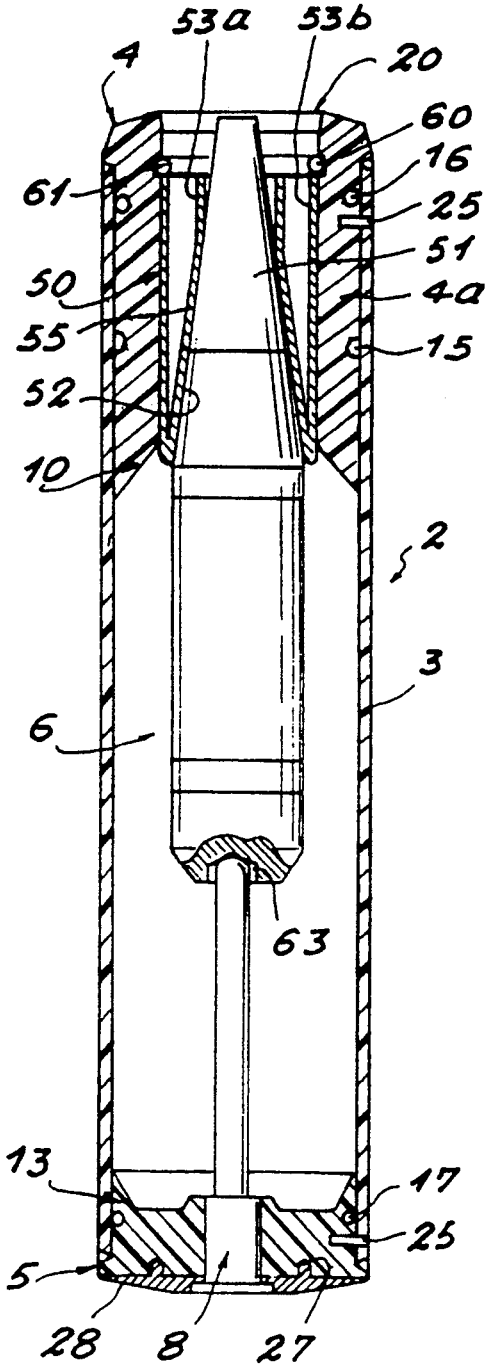
Figure 9:
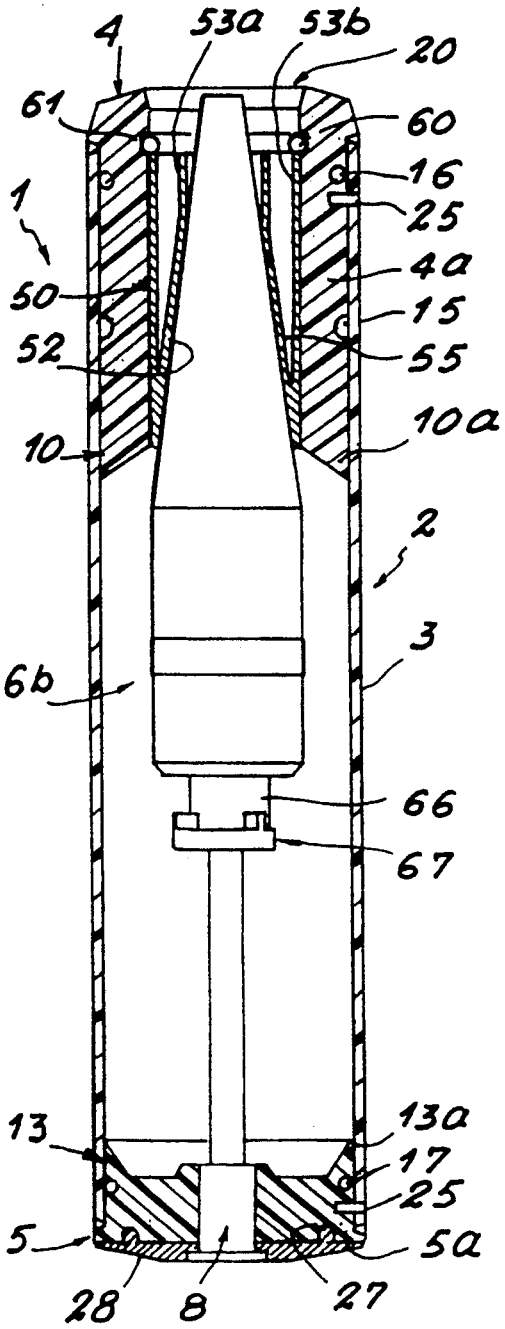
Figure 10:
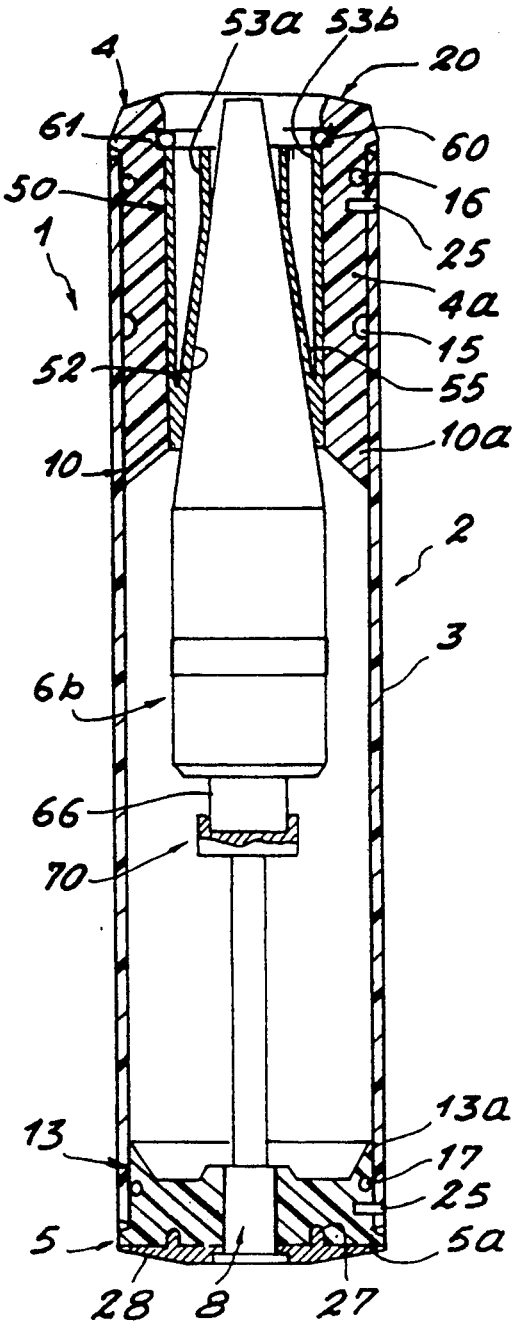

and FIGS. 8 to 10 are partial longitudinal cross-sectional views of a piece of ammunition according to the invention to illustrate devices for maintaining another kind of projectile in the center line of the ammunition.

Figure 1:
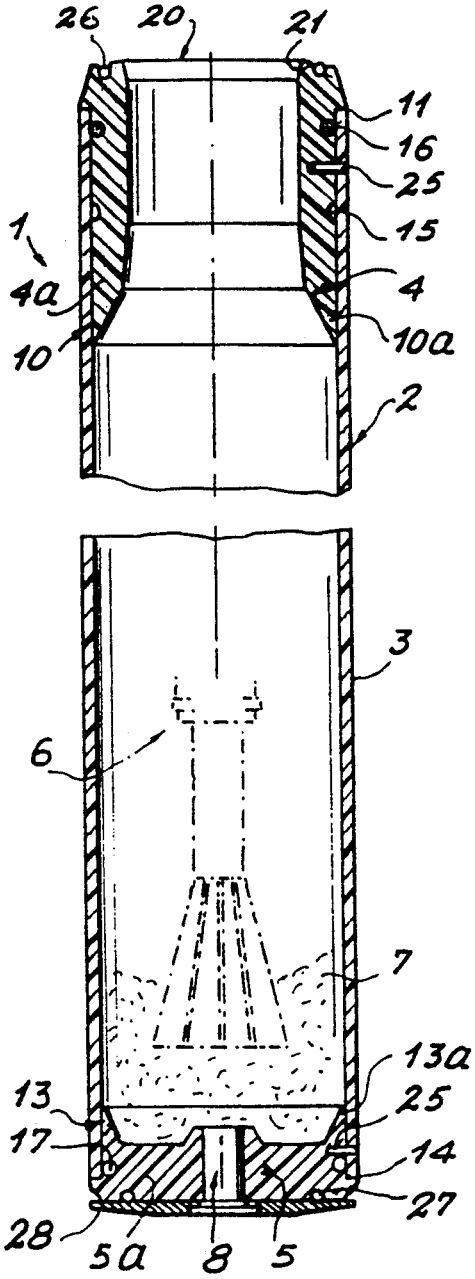
FIG. 1 is a partial longitudinal cross section of a piece of telescoped ammunition according to the invention to illustrate the sealing and axial retaining devices of the end caps.

The telescoped ammunition round shown in FIG. 1 comprises, a case 2 made from plastic material made up of a cylindrical casing 3 and two end caps, front end cap 4 and rear end cap 5, a projectile 6 (partially shown in dashes and straight lines) and a propulsive charge 7 housed inside the case 2, and an ignition device 8 for the propulsive charge 7. The case and the front and rear end caps are made, for example, from polycarbonate.

The front end cap 4 is made up of a ring **4*a* extended at one end by an annular seal 10 with a lip 10*a* having an external diameter, before mounting, greater than the internal diameter of the casing 3. The ring 4*a* is inserted into the casing 3, such that the body of the ring 4*a* slides against the internal wall of casing 3 while the seal 10 is pressed by means of its lip 10*a* against the casing 3. The ring 4*a* is inserted in the casing 3 until a shoulder 11** made in the external surface of the ring 4a comes into contact with the adjacent end surface of the casing 3. In concrete terms, the ring 4a extends a length L1 into the casing 3.

The rear end cap 5 is a solid cylindrical body or base 5a which closes the other end of the casing 3. At one end, the base 5a has an annular seal 13 with a lip 13a. The external diameters of the base 5a and of its seal with a lip 13 are such that the body of the base 5a slides against the internal wall of casing 3, while its seal 13 is secured by its lip 13a against the casing 3. The base 5a is inserted in the casing 3 until a shoulder 14 made in the external surface of the base 5a comes into contact with the adjacent end surface of casing 3. In concrete terms, the base 5a extends a length L2 into the casing 3. The gas sealing devices made up of seals 10 and 13 also comprise an annular expansion groove 15 made in the external edge of the body of the ring 4a.

Devices for sealing against external agents, in particular moisture, are also provided, such as by annular seal 16 held in an external annular groove in the body of the ring 4a, by an annular seal 17 held in an external annular groove of the body of the base 5a, and by a protective cover made from plastic 20 welded onto a bearing surface 21 made in the end of the ring 4a.

The ammunition round 1 is fitted with devices for axial retention of the ring 4a and of the base 5a before case 2 is resulting subjected to the increase in pressure from the ignition of the propulsive charge.

In the example under consideration here, these retaining devices are made up of radial pins 25 which traverse the casing 3 and which penetrate into the body of the ring 4a and into the body of the base 5a.

Once the ammunition round 1 has been positioned in the barrel of the cannon and after the propulsive charge 7 has been ignited, the increase in pressure inside the case 2 causes an increase in the diameter of the casing 3 which adheres to the internal wall of the combustion chamber. On the other hand, creep will occur in the plastic material at the front and rear end caps 4, 5, which is reflected in the formation of an annular bead. In order to avoid this creep in the plastic material, the front and rear end cap 4, 5 are strengthened with metal reinforcements.

In the example under consideration here, and still referring to FIG. 1, a metal ring 26 is provided at the front end of the ring 4a and a metal ring 27 inserted in the external face of the base 5a.

More precisely, the metal ring 26 is mounted on the external end face of the ring 4a, being force inserted into an annular groove made in the end surface of the ring 4a, or embedded in the ring 4a before molding. A similar assembly is provided for the metal ring 27 which reinforces the strength of the base 5a.

Preferably, rings 26 and 27 have external diameters near in size to the internal diameter of the casing 3 and are located outside this in order to avoid their expanding causing a rupture in casing 3. However, they are sufficiently near to casing 3 to prevent creep in the plastic material in between them and the casing 3.

Figure 3:
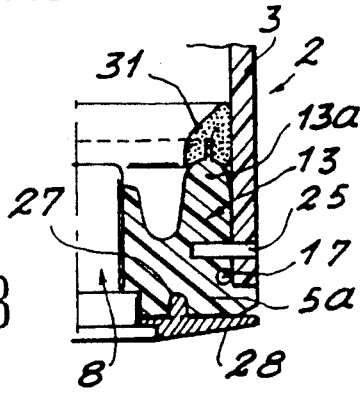

In the base 5a where the maximum pressure is exerted when the projectile is fired, extra reinforcements may be advantageously provided in the form of a metal plate 28 that covers the external face of base 5a. In this case, the aforementioned ring 27 may be advantageously rigid with this plate 28, with the base 5a then being duplicate moulded on top of this (FIG. 3). The plate 28 pierced with a central opening for the ignition device 8 to pass through is secured by this once it has been screwed into the axial passage crossing through the end cap 5.

With this telescoped ammunition, the front and rear end caps 4, 5 remain connected to the casing 2 by means of pins 25 until the ammunition is loaded into the chamber of the barrel of the cannon. After propulsive charge has been ignited, the pressure pertaining inside the ammunition is such that the pins 25 are either sheared or deformed sufficiently to allow the ring 4a and the base 5a to move, with these remaining still connected to the casing 2, so that they can then be simultaneously extracted with the casing once the projectile has been fired.

Figure 2:
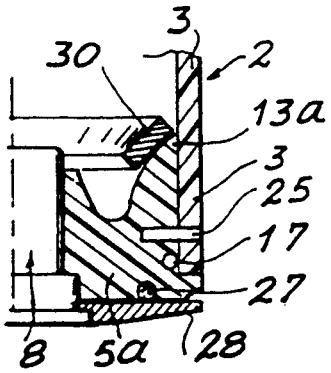
FIGS. 2 and 3 are partial cross-sectional views to illustrate variants of the sealing devices.

Variations in the embodiment in FIG. 1 are now going to be described. Referring to FIG. 2, the devices for keeping in the gases inside the base 5a of the piece of ammunition 1 may be supplemented with a metal ring 30 tapered in shape and press fitted inside the casing 2 and bearing against the lip 13a, or with an annular seal 31 made from rubber fitted on the end of the lips 13a, as shown in FIG. 3. The pins 25 which ensure axial securing of the front and rear end caps 4, 5 may be replaced by ultrasonically produced welds 35 made in the shoulders 11 of the ring 4a and 14 of the base 5a, as shown in FIG. 4.

Figure 5:
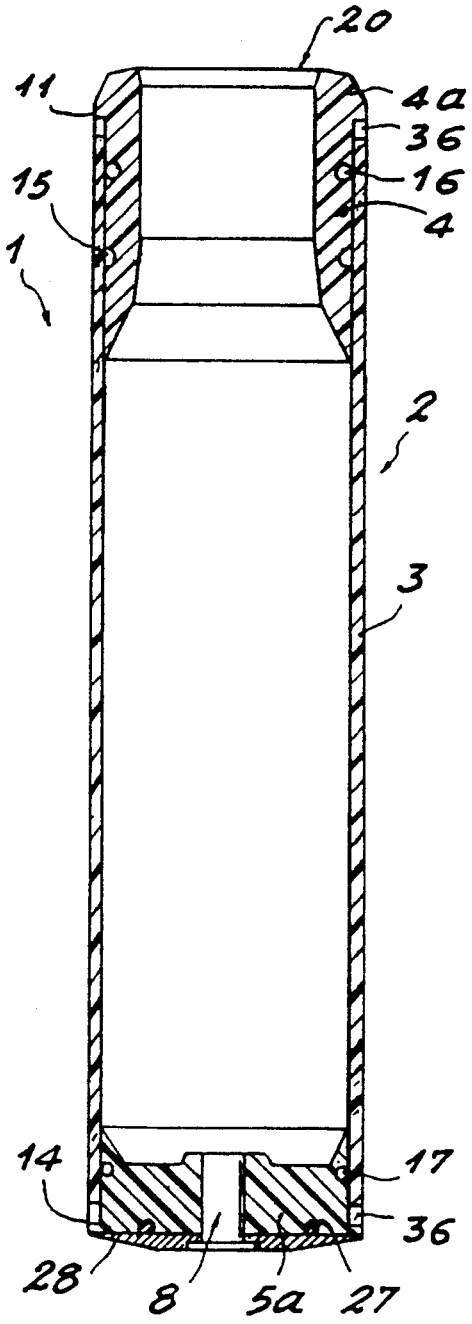

According to another variant shown in FIG. 5, the pins 25 and the ultrasonically produced welds 35 may be replaced by elastomer seals. For this, an axial play between 1 and 3 mm is left between the shoulder 11 of the ring 4a and the free adjacent end surface of the casing 2, and equivalent play is left between the shoulder 14 of the base 5a and the adjacent free end of the casing 3. These annular spaces are filled up with a seal 36 made from elastomer which will ensure axial security of the ring 4a and of the base 5a relative to the casing 3. When the pressure increases after the propulsive charge has been ignited, the ring 4a and the base 5a may move, but without breaking seals 36. Thus it is possible for the lips 10a and 13a of seals 10 and 13, i.e. components under stress whose mechanical characteristics may deteriorate over time, to be eliminated. In this case, the ring 4a and the base 5b are press fitted inside casing 3.

Figure 4:
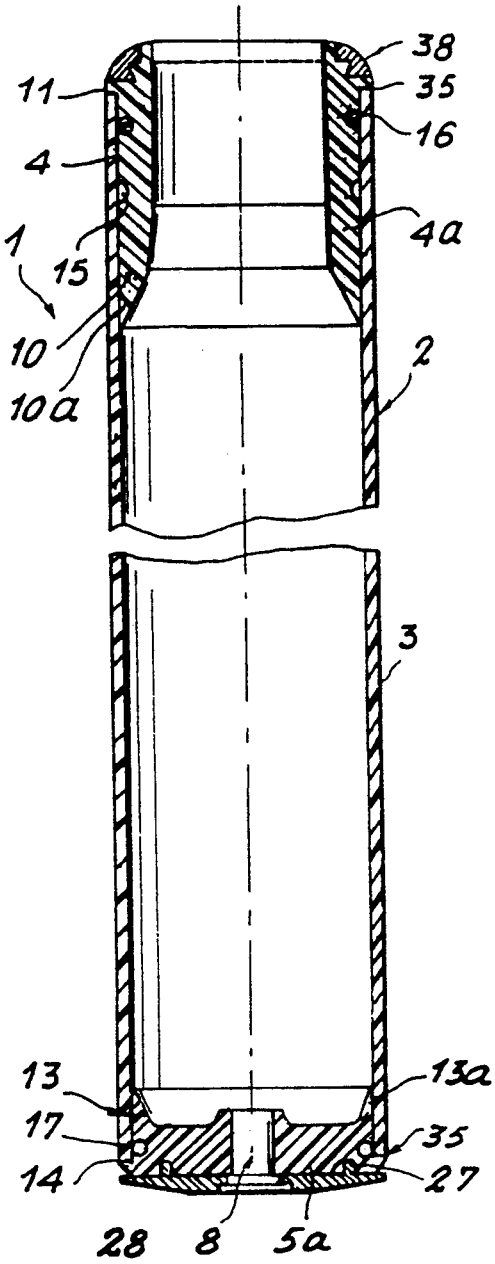
FIGS. 4 and 5 are partial longitudinal cross-sectional views of a telescoped ammunition round according to the invention to illustrate other axial retaining devices for the end caps.

The metal reinforcement of the front ring 4a made up of the metal ring 26 may be replaced by a rigid annular component 38 in the shape of a disk which nests, for example, on the front end of the ring 4a, as shown in FIG. 4. Similarly, this component may be fitted onto the base 5a and replace the metal ring 27 and/or the plate 28.

The ammunition round 1 is advantageously supplemented with devices which enable the projectile 6 to be axially secured inside the ammunition round 1 before the propulsive charge 7 is ignited.

Figure 6:
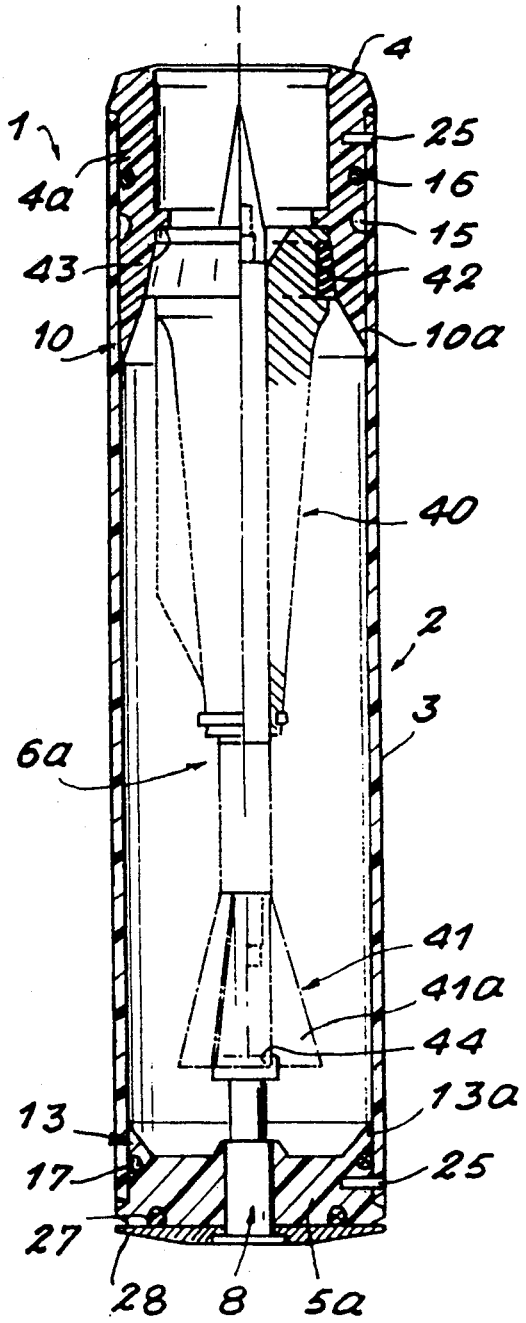
FIGS. 6 and 7 are partial longitudinal cross-sectional views of an ammunition round according to the invention to illustrate devices for maintaining a given type of projectile in the center line of the ammunition.
Figure 7:
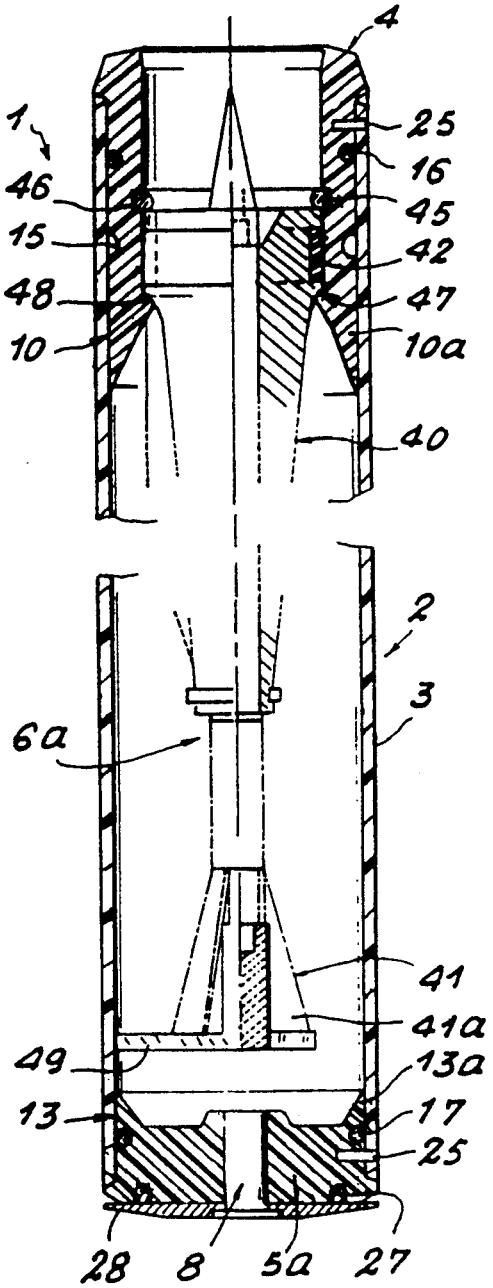

The ammunition round 1 shown in FIGS. 6 and 7 is fitted with sub-calibre projectiles 6a of the arrow type. This type of projectile 6a comprises a sabot 40 which surrounds the front part of the projectile, and terminates in a tail section 41. At its front the sabot 40 is in contact with the internal surface of the ring 4a with insertion of a belt 42 to ensure good sealing in this spot.

In the case of FIG. 6, the projectile 6a is kept in a straight line along the centre line of the ammunition round 1 using a projecting annular shoulder 43 on the internal wall of the ring 4a, against which bears the end surface of the sabot 40. During firing, this shoulder 43 is sheared. Axial securing of the projectile 6a may be supplemented by the ignition device 8 axially aligned with the projectile. For this it is sufficient to make the tail unit 41 rest on a collar 44 fitted onto the adjacent end surface of the ignition device 8 and to make notches in this, for example, in which the fins 41*a* of the tail unit 41 are housed.

According to a variant illustrated in FIG. 7, the projectile 6*a* is maintained in a straight line on the centre line of the piece of ammunition 1 using an elastic ring 45 partly fitted in an annular groove 46 made in the internal wall of the ring 4*a* and against which the end surface of the sabot 40 bears. Also provided in the ring 4*a* is a tapered surface 47 and a complimentary surface 48 in the sabot 40, with the aforementioned sealing belt 42 being situated between the ring 45 and the surfaces 47 and 48. The axial securing of the projectile 41 may be supplemented in the tail unit 41 with the wedge 49 as described in the document FR-2 647 891.

The devices for securing the projectile along the centre line of the piece of ammunition and as shown in FIGS. 8 to 10 relate to ammunition 1 fitted with full calibre projectiles 6*b*. The projectile 6*b* has at its front part a cover 50 which has an internal profile matching the external profiles of the ballistic head 51 and of the external surface 52 of the front part of the projectile 6*b*. The cover 50, made rigid with the projectile by bonding, comprises an internal collar 53*a* and an external collar 53*b* connected to each other by means of radial partitions (not shown) and by a tapered partition 55, with the external collar 53*b* being closely fitted to the ring 4*a*.

In the case of FIG. 8, the axial securing of the projectile 6*b* is ensured by an elastic ring 60 fitted partly into the groove 61 made in the internal surface of the ring 4*a* and against which the free end surface of the cover 50 bears. The axial securing of the projectile is supplemented by the ignition device 8 whose end fits into a housing 63 made in the rear part of projectile 6*b*.

In the case of FIG. 9, the projectile 6*b* is fitted with a tracer 66 in its rear part, so that it is not possible to make the ignition device penetrate into a housing in the rear of the projectile 6*b*. In this case a collar 67 may be provided fitted onto the end of the ignition device 8 and on top of which the tracer 66 rests.

According to a variant illustrated in FIG. 10, the projectile 6*b* comprises in its rear part a tracer 66, and the devices for axial securing of the projectile 6*b* are here supplemented with a threaded sleeve 70 which locks onto a thread made around the tracer 66, and in which the end of the ignition device 8 is housed. The shearing of the threads occurs with the increase in pressure so that their dimensions and/or their number can be adjusted in order to control the de-cartridging effort, i.e. the one with which the projectile 6*b* leaves the case.

It should be noted that all the devices for axial securing of the projectile shown in FIGS. 6 to 10 also ensure radial securing of the projectile.

Of course, the invention is in no way restricted to the various embodiments described above and given solely as examples. In particular, modifications to the devices that ensure sealing, strengthening and axial retention of the end cap, as well as the devices for axial and radial securing of the projectile inside the piece of ammunition, are within the scope of the following claims.

We claim:

1. A telescoped ammunition round, comprising:

a plastic case comprising a plastic cylindrical casing, a plastic front end cap comprising a ring slidably engaged at a front end of the casing, and a plastic rear end cap comprising a base slidably engaged at a rear end of the casing;

a projectile disposed within said casing;

a propellant charge disposed within said casing;

an ignition device disposed within said casing for igniting said propellant charge;

a sealing means for providing a gas-tight seal between said front end cap and said casing and between said rear end cap and said casing, said sealing means comprising a first annular seal extending from one end of the ring of the front end cap, said first annular seal comprising a lip press-fitted against an internal surface of said casing, and a second annular seal extending from one end of the base of said rear end cap, said second annular seal comprising a lip press-fitted against an internal surface of said casing; and axial retaining means for preventing longitudinal axial movement of said front and rear end caps before ignition of said propellant charge and for allowing axial movement of front and rear end caps after ignition of said propellant charge, wherein said front and rear end caps are not completely separated from said casing after ignition of said propellant charge, said axial retaining means selected from the group consisting of a deformable means and a shearable means, said axial retaining means comprising first and second retaining devices provided in addition to the front and rear end caps and the casing, said first retaining device being secured between said front end cap and said casing, said second retaining device being secured between said rear end cap and said casing.

2. The round of claim 1, wherein said first and second retaining devices each comprise at least one pin which is fixed to said casing and which penetrates its respective front or rear end cap, said pin being adapted to deform upon an increased pressure within the casing due to ignition of the round, thereby allowing axial movement of the front and rear end caps.

3. The round of claim 1, wherein said front and rear end caps each extend into said casing a length such that said front and rear end caps are partially disposed within said casing after ignition of said propulsive charge.

4. The round of claim 1, wherein said front and rear end caps further comprise metal reinforcement means.

5. The round of claim 4, wherein said metal reinforcement means comprises at least one metal ring fixed to said front end cap.

6. The round of claim 4, wherein said metal reinforcement means comprises at least one metal ring fixed to said rear end cap.

7. The round of claim 6, wherein said reinforcement means further comprises a metal plate fixed to and at least partially covering said rear end cap.

8. The round of claim 7, wherein said metal ring is fixed to said metal plate.

9. The round of claim 4, wherein said reinforcement means comprises an annular disk fixed to said front end cap, and an annular disk fixed to said rear end cap.

10. The round of claim 1, wherein said first and second retaining devices each comprise at least one pin which is fixed to said casing and which penetrates its respective front or rear end cap, said pin being adapted to shear upon an increased pressure within the casing due to ignition of the round, thereby allowing axial movement of the front and rear end caps.

11. The round of claim 1, wherein said first and second retaining devices each comprise at least one ultrasonically produced weld connecting its respective front or rear end cap to said casing, said weld being adapted to shear upon an increased pressure within the casing due to ignition of the round, thereby allowing axial movement of the front and rear end caps.

12. The round of claim 1, wherein said front end cap comprises an external shoulder in abutting contact with an adjacent end surface of said casing, and wherein said rear end cap comprises an external shoulder in abutting contact with an adjacent end surface of said casing.

13. The round of claim 1, wherein said first and second retaining devices each comprise at least one elastomer element connecting its respective front or rear end cap to said casing.

14. The round of claim 1, further comprising centering means to center the projectile within said casing, said centering means comprising an inwardly radially projecting shoulder extending from said front end cap to fixedly center the projectile.

15. The round of claim 14, wherein said shoulder is defined by an elastic ring disposed in an annular groove in an interior surface of said front end cap.

16. The round of claim 14, wherein a rear end surface of the projectile rests on said ignition device.

17. The round of claim 14, further comprising a cover fixed to the projectile, said cover being pressed-fitted in said front end cap, wherein a front end surface of said cover is in abutting contact with said shoulder.

18. The round of claim 14, wherein a rear section of the projectile terminates in a tracer having an outer threaded surface, wherein said centering means comprises a threaded sleeve threadedly engaging said tracer and fixed to said ignition device.

* * * * *